US009102882B2

(12) United States Patent
Balasubramaniyan et al.

(10) Patent No.: US 9,102,882 B2
(45) Date of Patent: Aug. 11, 2015

(54) GASIFICATION SYSTEM AND METHOD

(75) Inventors: Sethuraman Balasubramaniyan, Bangalore (IN); Pravin Sadashiv Naphade, Bangalore (IN); Richard Anthony DePuy, Burnt Hills, NY (US); Atul Kumar Vij, Bangalore (IN); Satish Sambhaji Jadhav, Vadodara (IN)

(73) Assignee: General Electric Company, Schenectady, NY (US)

( * ) Notice: Subject to any disclaimer, the term of this patent is extended or adjusted under 35 U.S.C. 154(b) by 7 days.

(21) Appl. No.: 13/603,368

(22) Filed: Sep. 4, 2012

(65) Prior Publication Data

US 2014/0061539 A1 Mar. 6, 2014

(51) Int. Cl.

| | |
|---|---|
| ***C10J 3/00*** | (2006.01) |
| ***C10J 3/48*** | (2006.01) |
| ***C10J 3/50*** | (2006.01) |
| ***C10J 3/72*** | (2006.01) |

(52) U.S. Cl.
CPC *C10J 3/506* (2013.01); *C10J 3/723* (2013.01); *C10J 2200/152* (2013.01)

(58) Field of Classification Search
USPC ..... 48/76, 67, 61, 127.9, 127.1, 95
See application file for complete search history.

(56) References Cited

U.S. PATENT DOCUMENTS

| | | | | |
|---|---|---|---|---|
| 3,844,733 | A | 10/1974 | Donath | |
| 4,773,917 | A * | 9/1988 | Morihara et al. | 48/77 |
| 4,872,886 | A | 10/1989 | Henley et al. | |
| 5,653,916 | A | 8/1997 | Disselhorst et al. | |
| 6,032,870 | A * | 3/2000 | Simoens | 239/1 |
| 6,206,949 | B1 | 3/2001 | Kobayashi et al. | |
| 7,793,601 | B2 | 9/2010 | Davison et al. | |
| 7,862,632 | B2 | 1/2011 | Yu et al. | |
| 7,959,829 | B2 | 6/2011 | Breton et al. | |
| 8,486,168 | B2 | 7/2013 | Dogru et al. | |
| 2006/0115779 | A1 * | 6/2006 | Yamamoto et al. | 431/115 |
| 2006/0120953 | A1 * | 6/2006 | Okuyama et al. | 423/648.1 |
| 2007/0006528 | A1 | 1/2007 | Diebold | |
| 2007/0294943 | A1 | 12/2007 | Van Den Berg et al. | |
| 2008/0073445 | A1 | 3/2008 | Yu et al. | |
| 2008/0134578 | A1 | 6/2008 | Yu et al. | |
| 2008/0141588 | A1 | 6/2008 | Kirchhubel et al. | |
| 2010/0251614 | A1 | 10/2010 | Ji | |

(Continued)

FOREIGN PATENT DOCUMENTS

| | | | |
|---|---|---|---|
| DE | 3617773 | A1 | 12/1986 |
| EP | 0050863 | A1 | 5/1982 |

(Continued)

OTHER PUBLICATIONS

Wang, Fu-Chen, et al.; "Process Analysis and Simulation of Shell Pulverized Coal Gasifier"; Journal of East China University of Science and Technology, vol. 29, No. 2, 2003-04, pp. 202-205.

(Continued)

*Primary Examiner* — Kaity Handal
(74) *Attorney, Agent, or Firm* — Fletcher Yoder, P.C.

(57) ABSTRACT

A system includes a gasifier. The gasifier includes a chamber, a first nozzle, and a second nozzle. The first nozzle is configured to output a first fuel and a first oxidant to create a mixture that combusts in a combustion-reduction zone of the chamber. The second nozzle is configured to output a reduction promoter into the combustion-reduction zone to reduce combustion products in the combustion-reduction zone of the chamber.

17 Claims, 5 Drawing Sheets

(56) References Cited

U.S. PATENT DOCUMENTS

| | | | | |
|---|---|---|---|---|
| 2011/0162376 | A1 | 7/2011 | Guo | |
| 2011/0168947 | A1 | 7/2011 | Ji et al. | |
| 2011/0182778 | A1 | 7/2011 | Breton et al. | |
| 2013/0192137 | A1 * | 8/2013 | Stevenson et al. | 48/61 |
| 2013/0192139 | A1 * | 8/2013 | Stevenson et al. | 48/197 R |

FOREIGN PATENT DOCUMENTS

| | | | |
|---|---|---|---|
| EP | 2199375 | A2 | 6/2010 |
| GB | 2082624 | A | 3/1982 |
| GB | 2138841 | A | 10/1984 |
| WO | 20020046331 | A1 | 6/2002 |
| WO | 20020048292 | A1 | 6/2002 |
| WO | 20050047435 | A2 | 5/2005 |
| WO | 20060056053 | A1 | 6/2006 |
| WO | 20090081282 | A2 | 7/2009 |

OTHER PUBLICATIONS

Xu, Shou-Ze et al.; "Stochastic model of residence time distribution in opposed tetra-burner gasifier"; Journal of Fuel Chemistry and Technology, vol. 34, No. 1, Feb. 2006, pp. 30-35.

PCT Search Report issued in connection with corresponding WO Patent Application No. US2011/020356 filed on Jan. 6, 2011.

* cited by examiner

GASIFICATION SYSTEM AND METHOD

BACKGROUND OF THE INVENTION

The subject matter disclosed herein relates to gasifiers, and more particularly, to systems and methods to increase the efficiency and operability of the gasifiers.

Gasifiers convert carbonaceous materials into a hot mixture of carbon monoxide and hydrogen, referred to as synthesis gas or syngas. The syngas is routed to one or more downstream applications, such as power generation systems or chemical production systems. Unfortunately, the syngas composition may not be suitable or optimal for the downstream application.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a gasifier. The gasifier includes a chamber, a first nozzle, and a second nozzle. The first nozzle is configured to output a first fuel and a first oxidant to create a mixture that combusts in a combustion-reduction zone of the chamber. The second nozzle is configured to output a reduction promoter into the combustion-reduction zone to reduce combustion products in the combustion-reduction zone of the chamber.

In a second embodiment, a system includes a gasification controller. The gasification controller is configured to control a first output and a second output into a combustion-reduction zone of a chamber of a gasifier. The first output includes a first fuel and a first oxidant from a first nozzle configured to create a mixture that combusts in the combustion-reduction zone. The second output includes a reduction promoter from a second nozzle configured to reduce combustion products in the combustion-reduction zone.

In a third embodiment, a method includes controlling a first output and a second output into a combustion-reduction zone of a chamber of a gasifier. The first output includes a first fuel and a first oxidant from a first nozzle to create a mixture that combusts in the combustion-reduction zone. The second output includes a reduction promoter from a second nozzle to reduce combustion products in the combustion-reduction zone.

In a fourth embodiment, a system includes a gasifier having a chamber. The gasifier has a nozzle configured to output a substance into the gasifier, wherein the nozzle has an adjustable depth into the chamber of the gasifier, and the adjustable depth includes a protruding position, a flush position, and a recessed position relative to an inner wall of the gasifier.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 7 is a partial cross-sectional view of an embodiment of the gasifier of FIG. 2 taken along line 7-7, illustrating a nozzle protruding from an inner wall of the gasifier into the combustion-reduction zone;

DETAILED DESCRIPTION OF THE INVENTION

Figure 1:
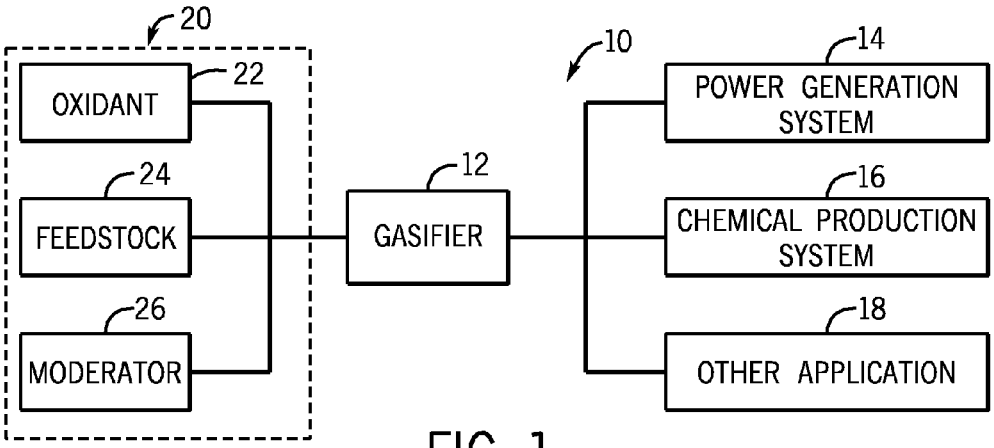
FIG. 1 is a schematic diagram of an embodiment of a gasification system including a gasifier.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to systems and methods to adjust the product slate (e.g., methane production or syngas composition) of a gasifier. In particular, the gasifier includes a primary nozzle to output a carbonaceous feedstock and an oxidant into the gasifier, which combust to produce a flame. The flame generally defines a flame region within the gasifier. As used herein, the terms "combusts" and "combustion" refer to full and/or partial combustion of reactants (i.e., oxidation of reactants). For example, fuel and oxygen may combust (e.g., partially combust by undergoing pyrolysis with subsequent oxidation) into carbon monoxide and hydrogen. In particular, a portion of the syngas reacts with the oxidant to produce the flame and a high temperature zone. A portion of the carbonaceous feedstock absorbs heat from the flame and reacts with the oxidant. Oxidation reactions may include, for example, reactions 1 through 3:

$$CO+0.5O_2 \rightarrow CO_2 \quad \text{(Reaction 1)}$$

$$H_2+0.5O_2 \rightarrow H_2O \quad \text{(Reaction 2)}$$

$$C+0.5O_2 \rightarrow CO \quad \text{(Reaction 3)}$$

The evaporated char within the carbonaceous feedstock reacts with steam within the flame region to produce syngas via reduction reactions. These reduction reactions may include, for example, reactions 4-6:

$$C+H2O \rightarrow CO+H2 \quad \text{(Reaction 4)}$$

$$C_nH_m+nH2O \rightarrow nCO+(n+m/2)H_2 \quad \text{(Reaction 5)}$$

$$C+CO2 \rightarrow 2CO \quad \text{(Reaction 6)}$$

Accordingly, the oxidation and reduction may occur simultaneously within the combustion-reduction zone. In other words, a portion of the feedstock is oxidized to produce the flame, whereas another portion is reduced into syngas.

Secondary nozzles of the gasifier output a similar or different carbonaceous feedstock into the flame region, thereby quenching the flame region. As will be appreciated, quenching the flame region creates a strong reducing environment that favors methane production. As used herein, the term "reduce" shall refer to reduction reactions that occur within the gasifier. For example, syngas may be reduced into methane through the use of a reduction promoter. The amount of feedstock that is output by the primary and secondary nozzles may be controlled in order to adjust the methane production within the flame region. In general, the flame region defines a combustion-reduction zone of the gasifier, wherein simultaneous combustion reactions (e.g., syngas production) and reduction reactions (e.g., methane production) occur. The simultaneous reactions improve the efficiency of the gasifier. In particular, the disclosed embodiments facilitate combustion and reduction reactions in a common region or space substantially at the same time, i.e., a one-stage combustion-reduction process, rather than allowing a combustion reaction to occur as a first stage at a first time and location followed by a reduction reaction as a second stage at a second time and location. As a result, the combined combustion-reduction process as a single stage may substantially improve the efficiency, performance, and general output (e.g., methane production) of the gasifier.

Turning now to the figures, FIG. 1 illustrates an embodiment of a gasification system 10 with a gasifier 12 configured to produce syngas and methane for one or more downstream applications. For example, the downstream application may be a power generation system 14, a chemical production system 16, or another application 18. In certain embodiments, the power generation system 14 may combust the syngas and extract work from the combustion products using a turbine, or the chemical production system 16 may react the syngas to form addition methane (e.g., a methanator).

Figure 2:
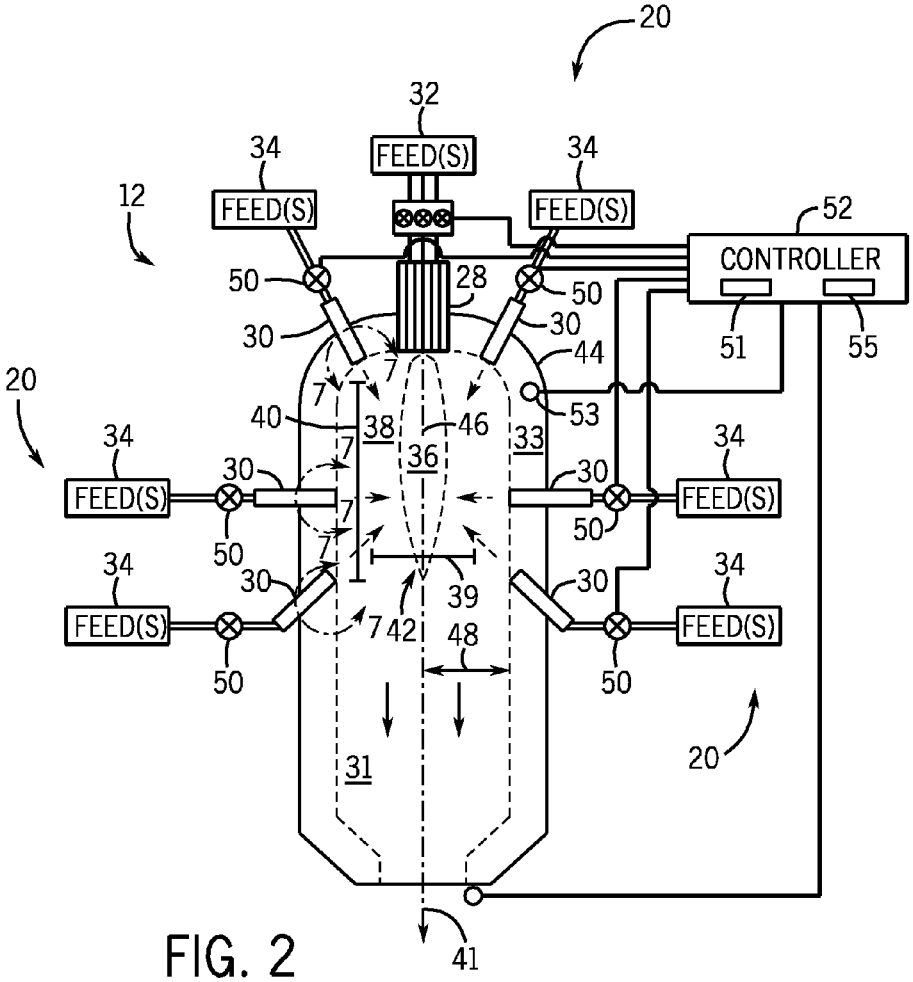
FIG. 2 is a diagram of an embodiment the gasifier of FIG. 1, illustrating primary and secondary nozzles configured to output one or more feeds into a combustion-reduction zone of the gasifier.

As illustrated, the gasifier 12 receives reactants from a feed system 20. The feed system 20 includes an oxidant 22 (e.g., oxygen and/or air), a feedstock 24 (e.g., coal, slurry, oil, gas), and an optional moderator 26 (e.g., steam). The oxidant 22, the feedstock 24, and the moderator 26 enter the gasifier 12 in a suitable ratio for syngas production and/or methane production. As illustrated in FIG. 2, the feed system 20 may supply the oxidant 22, the feedstock 24, and the moderator 26 to multiple locations within the gasifier 12. As discussed below, embodiments of the feed system 20 may include injectors to inject the oxidant 22, the feedstock 24, and the moderator 26, while also having secondary injectors to inject the feedstock 24 and/or the moderator 26 to facilitate a combustion-reduction reaction in a single stage.

FIG. 2 illustrates an embodiment of the gasifier 12 with multiple nozzles (e.g., primary nozzle 28 and secondary nozzles 30) to output reactants into a chamber 31 of the gasifier 12. The chamber 31 is generally defined by a refractory lining 33 of the gasifier 12. Although the illustrated embodiment includes a single primary nozzle 28 and six secondary nozzles 30, the number of nozzles may vary. For example, the gasifier may include 1, 2, 3, 4, 5, 6, or more primary nozzles 28 and 1, 2, 3, 4, 5, 6, or more secondary nozzles 30.

The primary nozzle 28 is coupled to a feed system 32 (e.g., 20). The feed system 32 may be similar or different than the feed system 20 of FIG. 1. For example, the feed system 32 for the primary nozzle 28 may output the oxidant 22, the feedstock 24, and the moderator 26 into the gasifier 12. Alternatively, the feed system 32 may not include the moderator 26. In general, the primary nozzle 28 outputs a mixture of the oxidant 22 and the feedstock 24 that combusts, thereby forming combustion products and producing a flame 36 within the gasifier 12.

In a similar manner, the secondary nozzles 30 are each coupled to a feed system 34 (e.g., 20). The feed system 34 may be similar or different to the feed system 20 of FIG. 1. However, in certain embodiments, the feed system 34 may not include the oxidant 22. For example, the secondary nozzles 30 may output a reduction promoter (e.g., the feedstock 24 and/or the moderator 26) into a flame region 38 to reduce the combustion products into methane. In addition, the secondary nozzles 30 may output a similar or different feedstock 24 as compared to the primary nozzle 28. For example, the primary nozzle 28 may output coal or coke slurry, while the secondary nozzles 30 output oil or another dry feedstock. In certain embodiments, the primary nozzle 28 may output between approximately 50 to 80 or 60 to 70 percent of the total feedstock into the chamber 31, whereas the secondary nozzles 30 output between approximately 20 to 50 or 30 to 40 percent of the total feedstock into the chamber 31.

Notably, each of the secondary nozzles 30 is directed towards the flame region 38 (e.g., toward the flame 36) to help quench the flame 36, thereby causing the products formed by the combustion reaction to quickly undergo a reduction reaction near the flame 36. As will be discussed further below, the flame region 38 includes the flame 36 and generally defines a combustion-reduction zone of the gasifier 12. That is, simultaneous combustion and reduction reactions occur within the flame region 38 (e.g., combustion-reduction zone) of the gasifier 12. For example, the flame region 38 may include the flame 36 and the space in close proximity to the flame and/or surrounding the flame 36. As combustion products form, they are rapidly (e.g. within seconds or fractions of a second) reduced into methane within the flame region 38. The simultaneous combustion and reduction reactions improve the efficiency of the gasifier 12.

The geometry of the flame region 38 may vary among embodiments. For example, the flame 36 extends a length 40 along an axis 41 into the gasifier 12, as measured from the primary nozzle 28 to a tip 42 of the flame 36. The flame region 38 may be defined as a portion of the chamber 31 extending from an upper dome 44 of the gasifier 12 to the tip 42 of the flame. Alternatively, the geometry of the flame region 38 may be defined by some percentage of the length 40 of the flame 36. For example, the flame region 38 may extend from the upper dome 44 for a length that is approximately 50 to 400, 100 to 300, or 150 to 200 percent of the length 40 of the flame 36, and all subranges therebetween.

Additionally or alternatively, the flame region 38 may be defined by a radial distance 39 from the flame 36, as measured from the tip 42 or a center 46 of the flame 36. For example, the chamber 31 of the gasifier 12 has a radius 48. The flame region 38 may be defined as a portion of the chamber 31 within some percentage of the radius 48 from the flame 36. For example, the flame region 38 may extend from the center 46 of the flame 36 in opposite radial directions for the radial distance 39 that is approximately 20 to 150, 50 to 120, or 80 to 100 percent of the radius 48 of the chamber 31, and all subranges therebetween. It should be noted that the aforementioned geometries are given by way of example, and are not intended to be limiting. For example, the geometry of the flame region 38 may be defined by additional or alternative factors, such as the temperature or pressure of the flame 36, the temperature gradients within the chamber 31, the amount of feedstock 24 through the primary nozzle 32, and the like.

As will be appreciated, the geometry of the flame region 38 may change based on the amount of reactants output by the primary and secondary nozzles 28 and 30. For example, an increased amount of oxidant 22 and feedstock 24 generally increases the length 40 of the flame 36, which may have corresponding effects on the flame region 38, as discussed previously. The geometry of the flame region 38 affects methane production and the composition of the syngas (e.g., carbon monoxide to hydrogen ratio). Accordingly, it may be desirable to adjust the output of the primary and secondary nozzles 28 and 30 to increase or decrease methane and/or syngas production. To this end, valves 50 are disposed between the feed systems 32 and 34 (e.g., 20) and their respective nozzles 28 and 30.

A controller 52 is communicatively coupled to the valves 50 (e.g., control valves). In certain embodiments, the controller 52 includes a processor 51, memory 55, and code or instructions stored on the memory 55 and executable by the processor 51 to perform various monitoring and control functions, as described herein. That is, the memory 55 is a tangible, non-transitory, machine-readable medium. The controller 52 may execute instructions to throttle the valves 50 to adjust the outputs of the primary and secondary nozzles 28 and 30 based on a reading from a sensor 53. As will be appreciated, the sensor 53 may execute instructions to detect a variety of operating parameters of the gasifier 12, such as temperature, pressure, flame color, flame temperature, and/or composition of the gasification products, as well as operating parameters of the feed systems, downstream systems (e.g., gas treatment systems), or any combination thereof. For example, the controller 52 may execute instructions to throttle the valves 50 in response to changes in the feedstock 24. The feedstock 24 may decrease in average molecular weight, resulting in a decreased temperature of the flame 36. The sensor 53 may detect the decreased flame temperature, and the controller 52 may throttle the valves 50 in response, decreasing the amount of reduction promoter output by the secondary nozzles 30. The decreased reduction promoter (e.g., decreased feedstock 24 through the secondary nozzles 30) lessens the quenching of the flame region 38, thereby ensuring an appropriate temperature of the flame region 38.

In addition, it may be desirable to control the temperature of the flame region 38 to increase or decrease the production of syngas and/or methane. In particular, the temperature of the flame region 38 is affected by a ratio (e.g. fuel ratio) of the feedstock 24 output by the primary nozzles 28 relative to the feedstock 24 output by the secondary nozzles 30. For example, increasing the amount of feedstock 24 through the secondary nozzles 30 further quenches the flame region 30, thereby decreasing the temperature of the flame region 38. The controller 52 may execute instructions to control the fuel ratio based on a temperature of the flame region 38 detected by the sensor 53. In certain embodiments, the fuel ratio may be controlled within approximately 0.5 to 5, 1 to 4, or 1.5 to 2.3, and all subranges therebetween.

The geometry of the flame region 38 may also be affected by the locations of the primary and secondary nozzles 28 and 30 within the gasifier 12. FIGS. 3-7 illustrate various positions of the nozzles 28 and 30. It should be noted that the embodiments shown in FIGS. 3-7 are given by way of example, and are not intended to be limiting. For example, the illustrated positions and orientations of the nozzles in FIGS. 3-7 may be combined with one another. That is, an embodiment of the gasifier 12 may include the nozzles of FIG. 3 in full or partial combination with the nozzles of FIGS. 4-7. In other words, the features of FIGS. 1-7 are intended for use together in various configurations, and are not intended to be mutually exclusive.

Figure 3:
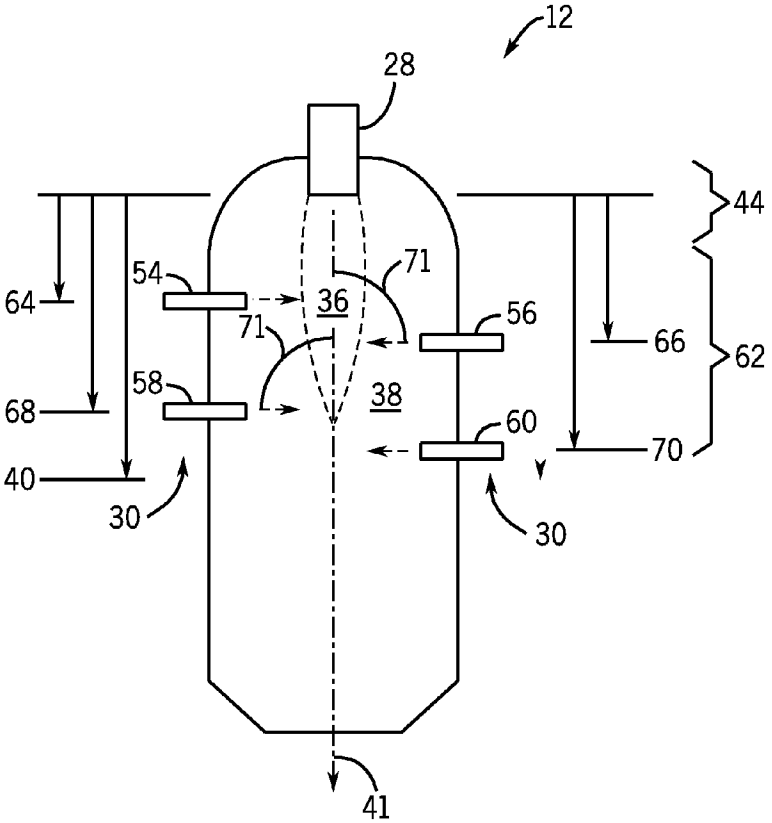
FIG. 3 is a diagram of an embodiment of the gasifier of FIG. 2, illustrating a primary nozzle disposed in an upper dome portion of the gasifier and a plurality of secondary nozzles disposed in an intermediate portion of the gasifier.

FIG. 3 illustrates an embodiment of the gasifier 12 with axially staggered secondary nozzles 30. As shown, the primary nozzle 28 is disposed in the upper dome portion 44. Secondary nozzles 54, 56, 58, and 60 (e.g., 30) are disposed in an intermediate portion 62 of the gasifier 12. The secondary nozzles 54, 56, 58, and 60 have corresponding elevations 64, 66, 68, and 70 relative to the primary nozzle 28. The elevations 64, 66, 68, and 70 vary from one another, defining an axially staggered configuration of the secondary nozzles 54, 56, 58, and 60. The axially staggered configuration enables the secondary nozzles 54, 56, 58, 60 to output the reduction promoter (e.g., feedstock 24 and/or moderator 26) into the flame region 38 at varying elevations, which may result in a more uniform temperature within the flame region 38 (e.g., more uniform quenching and promotion of the reduction reaction in the region 38).

In addition, the secondary nozzles 54, 56, 58, and 60 may output the reduction promoter at right angles 71 (e.g., 90-degree angles) relative to the axis 41 of the flame 36. That is, the primary nozzle 28 outputs the combustible mixture in a first direction (e.g., along or parallel to the axis 41), and the secondary nozzles 30 output the reduction promoter in a second direction crosswise (e.g., perpendicular) to the first direction. In certain embodiments, the direction of the flame 36 and the direction of the reduction promoter may converge at different angles, as discussed below with respect to FIG. 4.

Figure 4:
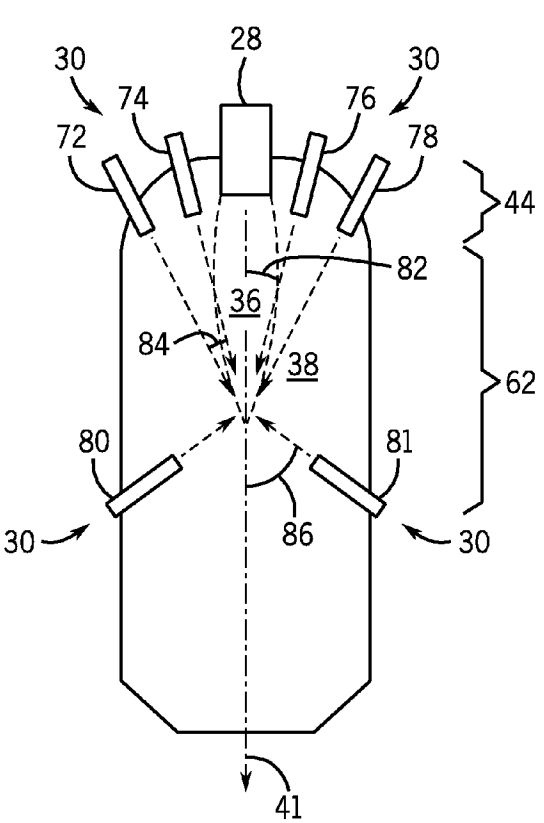
FIG. 4 is a diagram of an embodiment of the gasifier of FIG. 2, illustrating primary and secondary nozzles disposed in an upper dome portion of the gasifier.

FIG. 4 illustrates an embodiment of the gasifier 12 wherein the primary nozzle 28 and secondary nozzles 72, 74, 76, and 78 (e.g., 30) are disposed in the upper dome 44 of the gasifier 12. In addition, secondary nozzles 80 and 81 (e.g., 30) are disposed in the intermediate portion 62 of the gasifier 12. As shown, the secondary nozzles 72, 74, 76, 78, 80, and 81 output the reduction promoter at acute angles 82, 84, and 86 relative to the axis 41 of the flame 36. For example, the acute angles 82, 84, and 86 may be between approximately 0 to 89, 10 to 80, 20 to 70, 30 to 60, 40 to 50, or any suitable angle to direct the reduction promoter into the flame region 38. For example, the acute angels 82 and 84 may be approximately 0 to 45, 5 to 40, or 10 to 30 degrees in a downstream direction relative to the flame 36, whereas the angle 86 may be approximately 20 to 70, 30 to 60, or 40 to 50 degrees in the upstream direction toward the dome 44 and against the flame 36. The acute angles 82, 84, 86 may vary between the secondary nozzles 72, 74, 76, 78, 80, and 81, as shown. Outputting the reduction promoter at the acute angles 82, 84, and 86 may result in shorter residence times within the gasifier 12, thereby improving the efficiency or operability of the gasifier 12. Also, directing the promoter toward the flame 36 in upstream, downstream, crosswise, and/or parallel direction relative to the flame may facilitate the simultaneous combustion-reduction reactions in the flame region 38.

Figure 5:
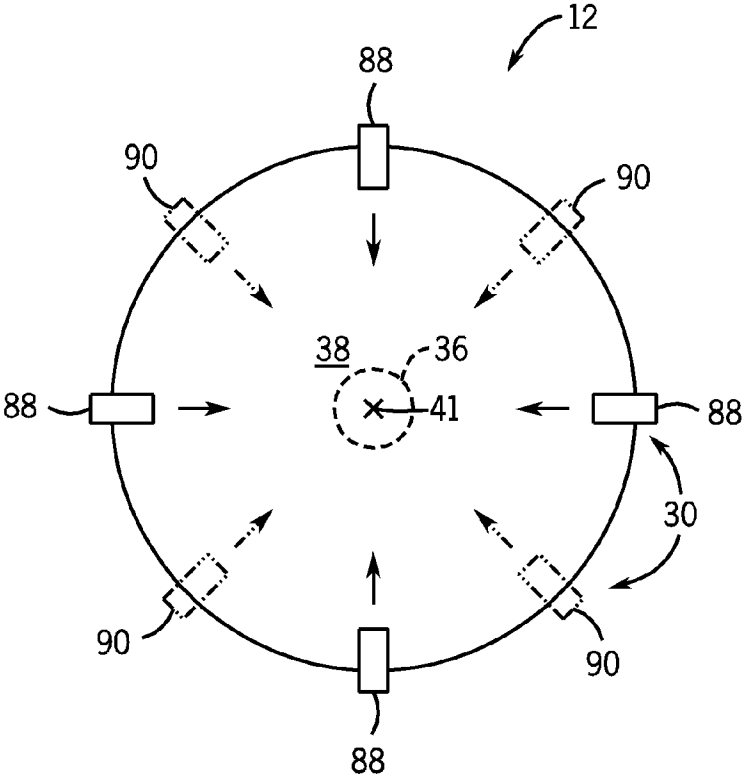
FIG. 5 is a partial cross-sectional view of an embodiment of the gasifier of FIG. 1, illustrating a plurality of secondary nozzles disposed circumferentially about the gasifier with varying axial positions.

FIG. 5 illustrates an embodiment of the gasifier 12 having the secondary nozzles 30 disposed in a circumferential arrangement about the axis 41. As shown, a subset of the secondary nozzles 30 shares a common elevation, as shown by the solid nozzles 88. Another subset of the secondary nozzles 30 shares a different elevation (e.g., axial position along the axis 41), as shown by the dashed nozzles 90. Each of the secondary nozzles 88 and 90 outputs the reduction promoter directly towards the axis 41 (i.e., radially converging with the axis 41) and the flame 36 at their respective elevations. As noted earlier, the nozzles 88 and 90 output the reduction promoter at varying elevations, which may result in a more uniform temperature (e.g., quenching and promotion of reduction reaction) of the flame 36 and increased control of the syngas and/or methane production.

Figure 6:
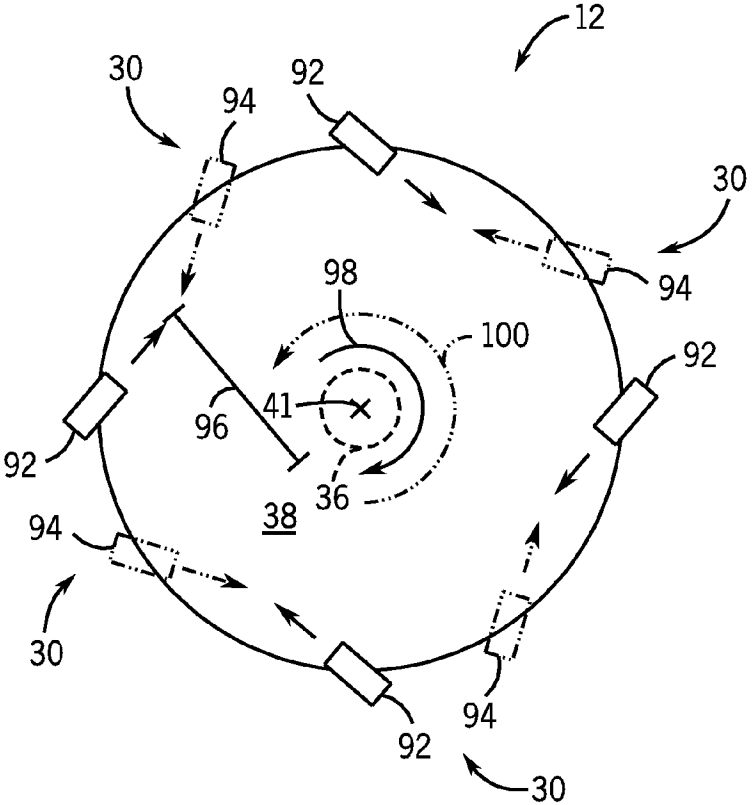
FIG. 6 is a partial cross-sectional view of an embodiment of the gasifier of FIG. 1, illustrating a plurality of secondary nozzles positioned to impart a swirl to an output into a combustion-reduction zone of the gasifier.

FIG. 6 illustrates an embodiment of the gasifier 12 with the secondary nozzles 30 positioned to create a swirling flow of the reduction promoter in the region 38 about the flame 36. Again, the solid nozzles 92 share a common elevation (e.g., axial position along the axis 41), and the dashed nozzles 94 share a different elevation (e.g., axial position along the axis 41). As shown, the solid nozzles 92 are angled to direct the reduction promoter at an offset 96 from the axis 41 of the flame 36. Accordingly, the solid nozzles 92 output the reduction promoter with a circumferential counterclockwise swirl 98 about the axis 41 and the flame 36. In a similar manner, the dashed nozzles 94 direct the reduction promoter at an offset 98 to produce a counter-clockwise swirl 100 about the flame 36 in the region 38. The opposite swirl directions 98 and 100 may result in a more uniform distribution of the reduction promoter, thereby improving dynamics within the flame region 38.

Figure 7:
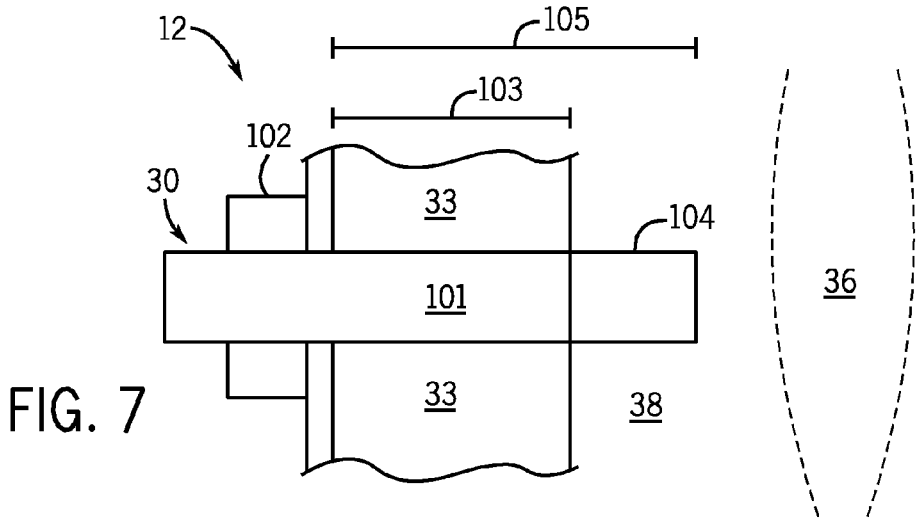
FIG. 7 is a partial cross-sectional view of an embodiment of the gasifier of FIG. 2, illustrating a nozzle protruding from an inner wall of the gasifier into the combustion-reduction zone.
Figure 8:
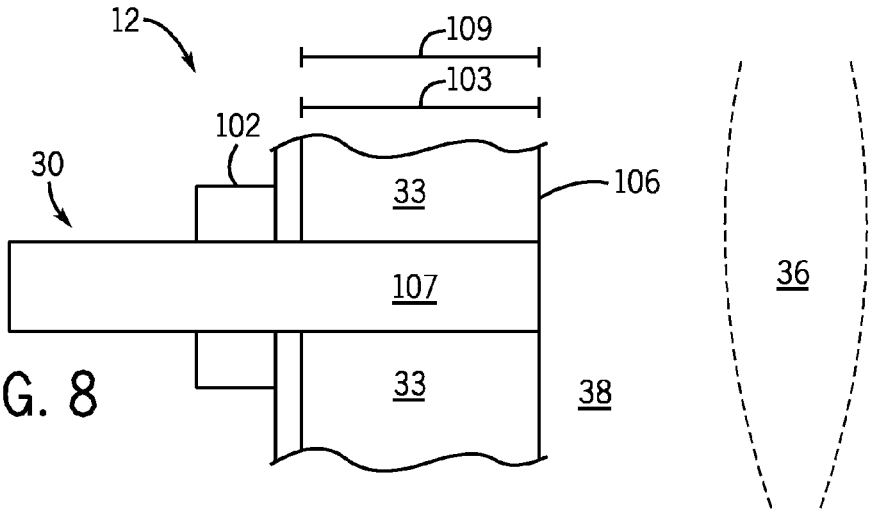
FIG. 8 is a partial cross-sectional view of an embodiment of the gasifier of FIG. 2 taken along line 7-7, illustrating a nozzle flush with an inner wall of the gasifier.
Figure 9:
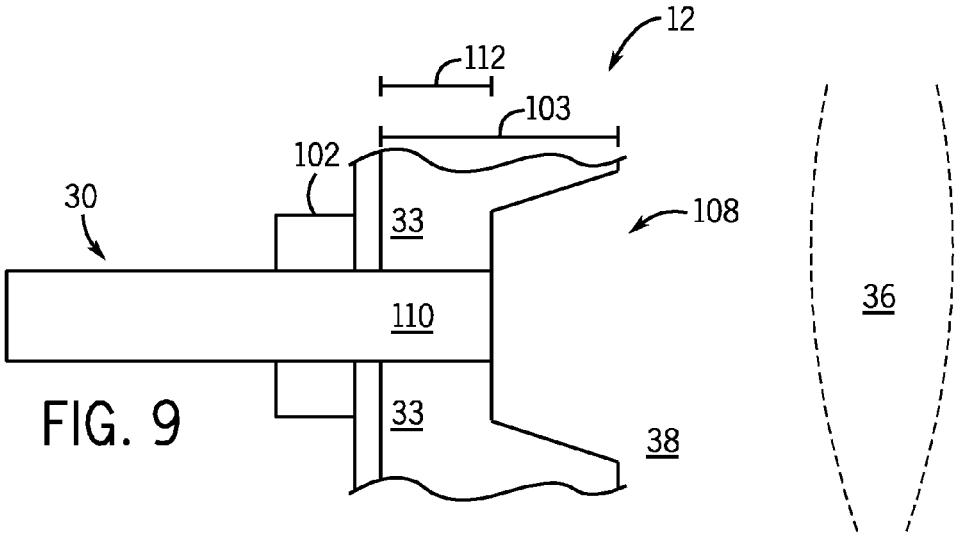
FIG. 9 is a partial cross-sectional view of an embodiment of the gasifier of FIG. 2 taken along line 7-7, illustrating a nozzle recessed from an inner wall of the gasifier away from the combustion-reduction zone.

FIGS. 7-9 illustrate respective protruding, flush, and recessed positions of the secondary nozzle 30 relative to the inner wall (e.g., refractory lining 33) of the gasifier 12. As shown, the secondary nozzle 30 is coupled to the gasifier 12 via a flange 102. The refractory lining 33 extends a depth 103 into the gasifier 12. In addition, a protruding secondary nozzle 101 (e.g., 30) of FIG. 7 extends a depth 105 radially into the gasifier 12. The difference between the depth 105 of the secondary nozzle 101 and the depth 103 of the refractory lining 33 defines a protruding portion 104 extending radially past the refractory lining 33. The protruding 104 portion decreases the possibility of fuel contacting the refractory lining 33 and increases fuel penetration into the flame region 38, and protects the nozzle 101 from slag flow along the lining 33.

FIG. 8 illustrates a flush secondary nozzle 107 (e.g., 30) that extends a depth 109 radially into the gasifier 12. The depth 109 of the secondary nozzle 107 and the depth 103 of the refractory lining 33 are approximately equal, creating a generally smooth surface 106 (or flush interface) at the interface of the refractory lining 33 and the nozzle 107. The smooth surface 106 lessens the possibility of erosion of the secondary nozzle 107, thereby increasing the operability and/or lifespan of the nozzle 107. Again, the depth 109 may be chosen to facilitate penetration of the promoter to a suitable location in the region 38 to facilitate the combustion-reduction process.

Similarly, FIG. 9 illustrates a recessed secondary nozzle 110 (e.g., 30) that extends a depth 112 radially into the gasifier 12. As shown, the depth 112 of the secondary nozzle 110 is less than the depth 103 of the refractory lining, defining an opening or recess 108 in the refractory lining 33. The opening 108 shields the secondary nozzle 110 from the high temperature of the flame region 38, thereby increasing the operability of the secondary nozzle 110 and promoting the combustion-reduction process.

As will be discussed further below, it may be desirable to adjust the depth of the secondary nozzle 30 between the protruding, flush, and recessed positions during operation of the gasifier 12. For example, during start-up operation of the gasifier 12, the secondary nozzle 30 may output a liquid feedstock 24. Increasing the depth of the secondary nozzle 30 may result in a protruding configuration (e.g., protruding secondary nozzle 101), thereby decreasing the possibility of the liquid feedstock 24 contacting the refractory lining. Once the gasifier 12 has reached operating temperature, the depth of the secondary nozzle 30 may be decreased to a recessed configuration (e.g., recessed secondary nozzle 110), thereby shielding the secondary nozzle 30 from the high temperature of the flame region 38 and/or protecting the nozzle 30 from a slag flow.

Figure 10:
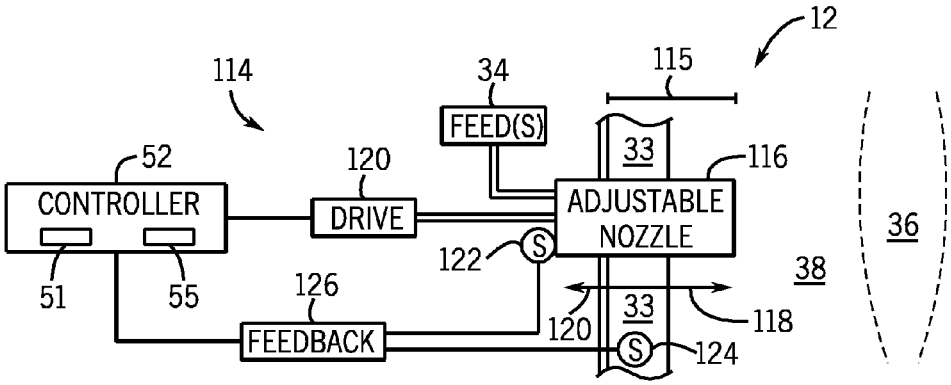

FIG. 10 illustrates an embodiment of a control system 114 having executable instructions to selectively adjust a depth 115 of an adjustable secondary nozzle 116 (e.g., 30) of the gasifier 12. For example, the depth 115 may be increased or decreased along arrows 118 and 120, respectively, to result in a protruding configuration (e.g., protruding secondary nozzle 101), a flush configuration (flush secondary nozzle 107), or a recessed configuration (e.g., recessed secondary nozzle 110). Again, the control system 114 includes the controller 52, which includes the processor 51 and the memory 55. Instructions are stored on the memory 55 and are executable by the processor 51 to perform various monitoring and control functions, as described herein.

As shown, the controller 52 is coupled to a drive 120. The drive 120 moves the adjustable secondary nozzle 116 between the protruding, flush, and recessed configurations. The controller 52 may execute instructions to control operation of the drive 120 based on input from sensors 122 and 124 as indicated by feedback 126. The sensor 122 detects a position of the adjustable secondary nozzle 116, and the controller 52 may adjust the drive 120 based on the detected position. In a similar manner, the sensor 124 detects a temperature of the refractory lining 33. The controller 52 may execute instructions to monitor the sensors 122 and 124, to receive signals from the sensors 122 and 124, and to process the signals (e.g., by applying filters and the like) to provide suitable control of the drive 120 to adjust the position of the nozzle 116.

Figure 11:
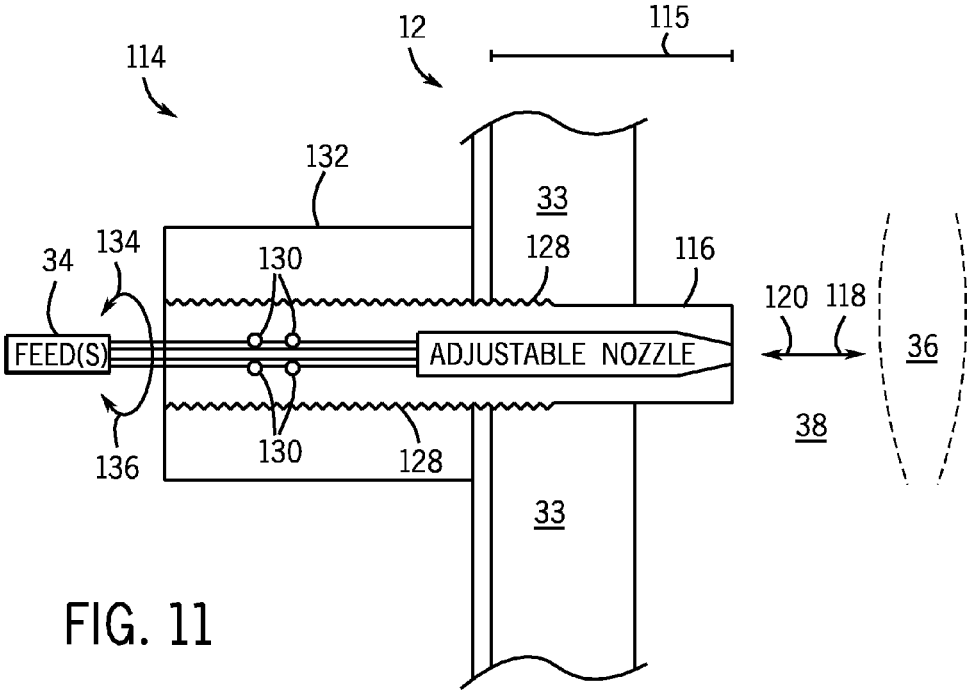
FIG. 11 is an illustration of an embodiment of the adjustable nozzle of FIG. 10.

FIG. 11 illustrates an embodiment of the adjustable secondary nozzle 116 having threads 128 and o-rings 130 to adjust the depth 115 of the nozzle 116. For example, a threaded coupling 132 may be rotated along arrows 134 and 136 to respectively increase or decrease the depth 115 along the arrows 118 and 120. The o-rings 130 form a hermetical seal between the threaded coupling 132 and the nozzle 116. The adjustable nozzle 116 may be manually actuated or automatically actuated by the drive 120 of FIG. 10.

Technical effects of the disclosed embodiments include adjustable nozzles (e.g., 116) to drive simultaneous or near-simultaneous combustion and reduction reactions within the flame region 38 of the gasifier 12. The simultaneous reactions improve the efficiency of the gasifier 12. In addition, adjusting the fuel ratio between the primary nozzles 28 and secondary nozzles 30 of the gasifier 12 enables adjustment of the syngas production and/or methane production within the gasifier 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a gasifier having a chamber comprising a combustion-reduction zone;

a first nozzle disposed along a central axis of the gasifier, wherein the first nozzle is configured to supply a first fuel and an oxidant to create a mixture in the combustion-reduction zone, and wherein a portion of the mixture is configured to oxidize to generate a flame within the combustion-reduction zone;

a second nozzle disposed off-axis to the central axis of the gasifier, wherein the second nozzle is configured to supply a reduction promoter to the combustion-reduction zone, wherein the reduction promoter is configured to reduce combustion products within the combustion-reduction zone; and a gasification controller configured to control flow of the reduction promoter through the second nozzle into the gasifier to increase a methane production by chemically reducing the combustion products generated from the first fuel in response to one or more sensed parameters, wherein the combustion products comprise syngas, wherein at least one of the sensed parameters is indicative of a temperature of the flame, wherein the gasification controller is configured to control a fuel ratio between the first fuel and the reduction promoter, wherein the gasification controller is configured to control the fuel ratio based at least partially on the temperature of the flame.

2. The system of claim 1, wherein the combustion-reduction zone is configured to oxidize the mixture into the combustion products and substantially simultaneously reduce the combustion products.

3. The system of claim 1, wherein the second nozzle is configured to output the reduction promoter directly toward the flame.

4. The system of claim 1, wherein the second nozzle is configured to output the reduction promoter circumferentially around the flame region as a swirling flow.

5. The system of claim 1, wherein the reduction promoter comprises a second fuel, a steam, or a combination thereof.

6. The system of claim 1, wherein the first and second nozzles are disposed in an upper dome portion of the gasifier.

7. The system of claim 1, wherein the first nozzle is disposed in an upper dome portion of the gasifier, and the second nozzle is disposed in an intermediate portion of the gasifier.

8. The system of claim 1, wherein the first nozzle is configured to output the first fuel and the oxidant in a first direction to create the flame within a flame region of the combustion-reduction zone, and the second nozzle is configured to output the reduction promoter in a second direction into the flame region to quench the flame region.

9. The system of claim 8, wherein the first and second directions converge toward one another.

10. The system of claim 9, wherein the first and second directions converge toward one another with an angle of approximately 90 degrees.

11. The system of claim 9, wherein the first and second directions converge toward one another with an acute angle.

12. The system of claim 1, wherein the second nozzle is configured to be selectively moved between a protruding position, a flush position, and a recessed position relative to an inner wall of the gasifier.

13. A method, comprising:

controlling, via a gasification controller, a flow of a reduction promoter through a nozzle into a gasifier to increase a methane production by chemically reducing combustion products generated from a fuel supplied through another nozzle in response to one or more sensed parameters, wherein the combustion products comprise syngas, wherein the combustion products are generated in a combustion-reduction zone of the gasifier, wherein at least one of the sensed parameters is indicative of a temperature of the flame; and controlling, via the gasification controller, a fuel ratio between the fuel and the reduction promoter, wherein controlling the fuel ratio comprises controlling the fuel ratio based at least partially on the temperature of the flame.

14. The method of claim 13, comprising controlling, via the gasification controller, flow of the fuel and an oxidant into the gasifier to create a mixture that combusts in the combustion-reduction zone of a chamber of the gasifier to form the flame.

15. The method of claim 14, comprising combusting the mixture into the combustion products and substantially simultaneously reducing the combustion products.

16. A system comprising:

a gasification controller configured to control flow of a reduction promoter through a nozzle into a gasifier to increase a methane production by chemically reducing combustion products generated from a fuel supplied through another nozzle in response to one or more sensed parameters, wherein the combustion products comprise syngas, wherein the combustion products are generated in a combustion-reduction zone of the gasifier, wherein at least one of the sensed parameters is indicative of a temperature of the flame generated by the fuel in the combustion-reduction zone of the gasifier, wherein the gasification controller is configured to control a fuel ratio between the fuel and the reduction promoter and to control the temperature of the flame, wherein the gasification controller is configured to control the fuel ratio based at least partially on the temperature of the flame.

17. The system of claim 16, comprising the gasifier having the nozzles.

* * * * *